US005174713A

United States Patent [19]

Iwai et al.

[11] Patent Number: 5,174,713

[45] Date of Patent: Dec. 29, 1992

[54] CIRCUMFERENTIAL FLOW TYPE FUEL PUMP

[75] Inventors: Shingo Iwai; Hiroshi Yoshioka, both of Hiroshima, Japan

[73] Assignee: Mitsubishi Denki Kabushiki Kaisha, Tokyo, Japan

[21] Appl. No.: 724,102

[22] Filed: Jul. 1, 1991

[30] Foreign Application Priority Data

Jul. 6, 1990 [JP] Japan ..... 2-177233

[51] Int. Cl.[5] ..... F01D 1/12

[52] U.S. Cl. ..... 415/55.1; 415/55.4

[58] Field of Search ..... 415/55.1, 55.2, 55.3, 415/55.4, 55.5, 55.6, 55.7

[56] References Cited

U.S. PATENT DOCUMENTS 4,591,311 5/1986 Matsuda .

4,692,092 9/1987 Matsuda et al. ..... 415/55.1

4,958,984 9/1990 Aoi et al. ..... 415/55.1

*Primary Examiner*—Edward K. Look

*Assistant Examiner*—Christopher M. Verdier

*Attorney, Agent, or Firm*—Leydig, Voit & Mayer

[57] ABSTRACT

A circumferential flow type fuel pump has an impeller rotated by engagement between a hole in the impeller and a rotating shaft having a diameter smaller than that of the hole. The center ofthe hole is eccentric with respect to the center of the impeller in accordance with the difference between the diameter of the hole and the diameter in section of the rotating shaft, so that the center of the impeller coincides with the center of the rotating shaft during rotation of the impeller.

6 Claims, 2 Drawing Sheets

CIRCUMFERENTIAL FLOW TYPE FUEL PUMP

BACKGROUND OF THE INVENTION

This invention relates to a circumferential flow type fuel pump for use in, e.g., combustion engines of motor vehicles having a centrifugal liquid pump.

FIG. 2 is a sectional view showing a conventional circumferential flow type fuel pump for a motor vehicle disclosed in, e.g., Japanese Patent Unexamined Publication No. 79193/1985 and FIG. 3 is a sectional view taken along line III—III of FIG. 2.

In FIGS. 2 and 3, a pump body 1 includes a power supply section 2, a motor 3, a centrifugal pump section 4, and an outer casing 5. A rotating shaft 3*a* of the motor 3 is pivotably supported by a first bearing 2*a* of the power supply section 2 and a second bearing 4*a* of the pump section 4.

The pump section 4 includes a pump casing 41, an impeller 42, and a pump cover 43. The pump casing 41 is press-fit into the outer casing 5. The pump cover 43 is secured to the open end portion of the outer casing 5 by caulking. The impeller 42 is disposed between the pump casing 41 and the pump cover 43. The impeller 42 has a substantially D-shaped hole 42*b*, and the center Q of the circular portion of this hole 42*b* coincides with the center P of the impeller 42. An end portion of the rotating shaft 3*a* fits into this hole 42*b*. The end portion of the rotating shaft 3*a* is substantially D-shaped like the hole 42*b*, with its diameter being slightly smaller than that of the hole 42*b*.

A circumferential fuel flow path 44 is formed in both the pump casing 41 and the pump cover 43 around the outer periphery of the impeller 42. Around the outer periphery of the impeller 42 facing the fuel flow path 44 are a plurality of vanes 42*a* which perform a pumping action.

An upstream end of the fuel flow path 44 communicates with a fuel inlet 45 disposed on the pump cover 43, while a downstream end of the fuel path 44 communicates with a delivery guide section 21 disposed at the power supply section 2 through an outlet 46 disposed at the pump casing 41 and a motor chamber. The upstream end and downstream end of the fuel flow path 44 neighbor through a flow path partition wall 41*a* disposed at the pump casing 41. The flow path partition wall 41*a* confronts the outer periphery of the impeller 42 with a tiny gap 6 therebetween.

The operation of the pump will be described next. The motor 3 is driven by an external power source through the power supply section 2. The motor 3 causes the impeller 42 engaged with the rotating shaft 3*a* of the motor to rotate, thereby making the impeller serve as a pump and sucking fuel from the inlet 45. The sucked fuel flows from the fuel flow path 44 to the outlet 46, the motor chamber, and to the delivery guide section 21 so as to be supplied to an engine (not shown).

Most of the fuel that flows to the downstream end of the fuel flow path 44 collides with the flow path partition wall 41*a* and flows into the outlet 46. However, part of this fuel returns to the upstream end of the fuel flow path 44 through the tiny gap 6.

As shown in FIG. 3, when the impeller 42 is rotated clockwise in the figure, the center O of the portion which is circular in section of the rotating shaft 3*a* coincides with the center P of the impeller 42 and is deviated by substantially half the difference in diameter between the rotating shaft 3*a* and the hole 42*b*, i.e., $\Delta r$, since both the end portion of the rotating shaft 3*a* and the hole 42*b* are substantially D-shaped and, at the same time, the end portion of the rotating shaft 3*a* has a diameter slightly smaller than that of the hole 42*b*. A preferable difference between the diameter in section of the end portion of the rotating shaft 3*a* and the diameter of the hole 42*b* is on the order of 30 to 50 $\mu$m. Therefore, the eccentricity $\Delta r$ is in the range of 15 to 25 $\mu$m, and hence the tiny gap 6 varies by 30 to 50 $\mu$m at portions (A) and (B) of the impeller 42 shown in FIG. 3.

In the thus constructed circumferential flow type fuel pump, the tiny gap 6 varies with rotation of the impeller 42. As a result, small variations (pulsation) are caused in the pressure of the fuel to be supplied to an engine or the like, or small vibrations are generated at the pump body 1, which vibrations become resonant with the fittings of the pump body 1 and the fuel supply piping, eventually leading to noise.

SUMMARY OF THE INVENTION

The present invention was made in view of the above circumstances. An object of the invention is to provide a circumferential flow type fuel pump capable not only of reducing the variation of the tiny gap between the impeller and the flow path partition wall but also of preventing small vibrations of the pump body, thereby preventing noise.

According to the present invention, a circumferential flow type fuel pump has an impeller rotated by engagement between a hole in the impeller and a rotating shaft having a diameter smaller than that of the hole. The center of the hole is eccentric with respect to the center of the impeller in accordance with the difference between the diameter of the hole and the diameter in section of the rotating shaft, so that the center of the impeller coincides with the center of the rotating shaft during rotation of the impeller.

In the invention the center of the impeller in rotation is made to coincide with the center of the rotating shaft by providing an eccentricity to the center of the hole of the impeller.

DETAILED DESCRIPTION OF THE PREFERRED EMBODIMENTS

Figure 1:
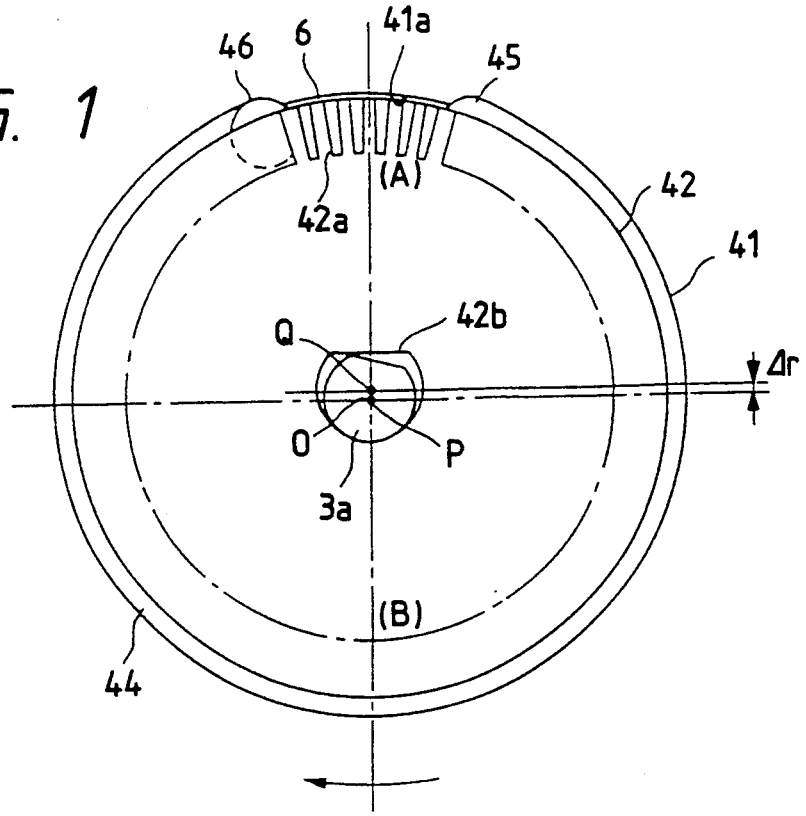
FIG. 1 is a sectional view of an embodiment of the invention.
Figure 3:
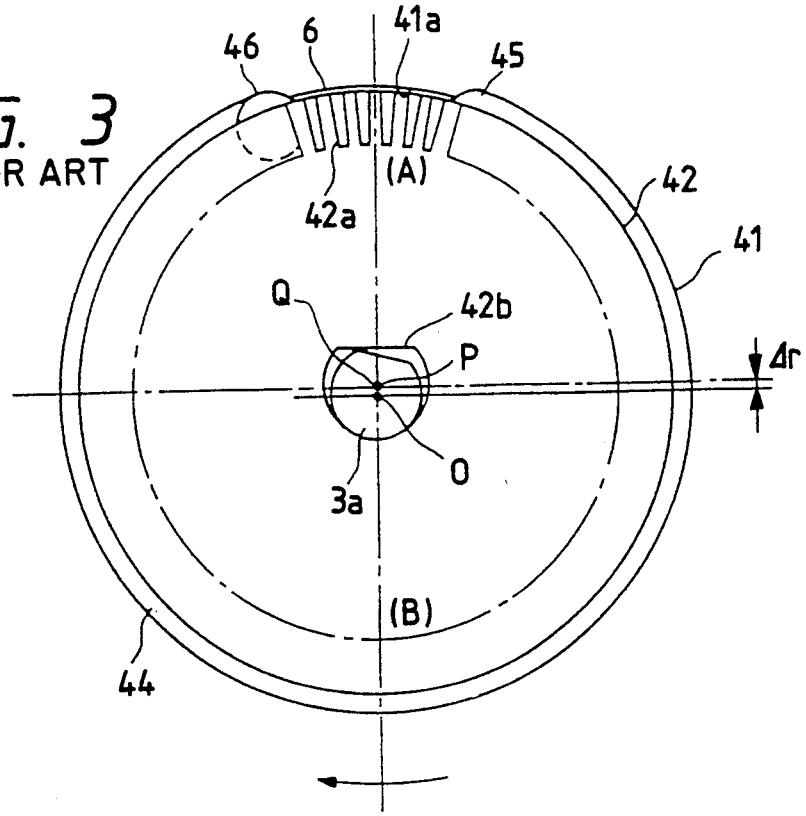
FIG. 3 PRIOR ART
FIG. 3 is a sectional view taken along line III—III of FIG. 2.
Figure 2:
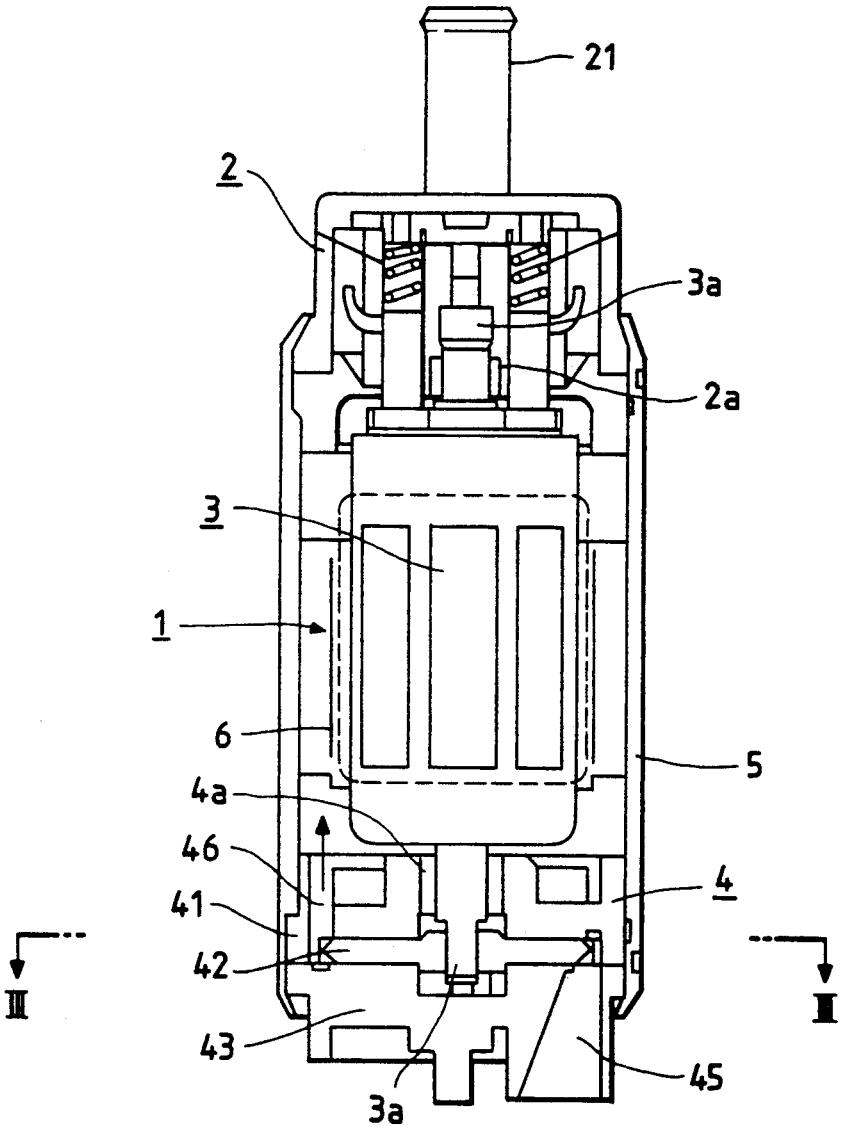
FIG. 2 PRIOR ART
FIG. 2 is a sectional view of a conventional pump.

An embodiment of the invention will be described with reference to the accompanying drawings. FIG. 1 is a sectional view of a circumferential flow type fuel pump according to this invention. The same or like parts and components shown in FIG. 1 as those shown in FIGS. 2 and 3 are designated by the same reference numerals and characters, and the description thereof will be omitted.

In FIG. 1, the center Q of the hole 42*b* of the impeller 42 is eccentric with respect to the center P of the impeller 42 by a distance $\Delta r$. Accordingly, the center P of the impeller 42 at the time of its rotation substantially coincides with the center O of the rotating shaft 3*a*. Since the difference between the diameter of the circular portion of the hole 42*b* and the diameter of the portion which is circular in section of the rotating shaft 3*a* is about 30 to 50 μm, the eccentricity Δr is preferably be set to about half the difference, i.e., about 20 μm.

In the circumferential flow type fuel pump constructed as described above, the center P of the impeller 42 during rotation substantially coincides with the center O of the rotating shaft 3*a*. Therefore, the variation of the tiny gap 6 is small when the impeller 42 is rotating. For example, if Δr is set to 20 μm, then the variation in the tiny gaps 6 at portion (A) and portion (B) of the impeller 42 in FIG. 3 can be confined to about 10 μm. From the fact that the tiny gap 6 is usually set to approximately 50 μm, it is understood that its variation is reduced to a considerable degree compared with the conventional example.

As a result, not only the variation in the pressure of the fuel to be supplied to the engine or the like is reduced, but also the load applied to the motor 3 is stabilized. It is for this reason that the circumferential flow type fuel pump has stable performance and high reliability. In addition, small vibrations of the pump body 1 are prevented, which contributes to eliminating the source of noise.

While a circumferential flow type fuel pump for use in motor vehicles is described in the above embodiment, it goes without saying that the invention may be applied to a circumferential flow type fuel pumps for other uses.

As described above, the circumferential flow type fuel pump of the present invention is arranged so that the center of the hole in the impeller is eccentric with respect to the center of the impeller in accordance with the difference between the diameter of the hole and the diameter in section of the rotating shaft so that the center of the impeller in rotation can coincide with the center of the rotating shaft. Therefore, the variation in the tiny gap communicating between the upstream and downstream ends of the fuel flow path can be reduced, thereby not only preventing the delivery pressure of the fuel from pulsating, but also stabilizing the load applied to the motor. As a result, stable pump performance and improved reliability can be obtained. Further, small vibrations of the pump body can be prevented, thereby keeping the pump from noise.

What is claimed is:

1. A circumferential flow type fuel pump in which an impeller is rotated by engaging a hole disposed on said impeller with a rotating shaft having a diameter smaller than that of said hole characterized in that:

a center of said hole is eccentric with respect to a center of said impeller in accordance with a difference between a diameter of said hole and a diameter in section of said rotating shaft, so that the center of said impeller in rotation overlaps the center of said rotating shaft.

2. A circumferential flow type fuel pump according to claim 1 wherein the center of said hole is set to be eccentric with respect to the center of said impeller by about half the difference between the diameter of said hole and the diameter in section of said rotating shaft.

3. A circumferential flow type fuel pump comprising:

a drive shaft having a center of rotation and a circular portion having a first diameter;

an impeller having a center and a hole formed therein, the hole surrounding the drive shaft and having a circular portion having a center and a second diameter larger than the first diameter, the center of the circular portion of the hole being eccentric with respect to the center of the impeller.

4. A fuel pump as claimed in claim 3 wherein the center of the circular portion of the hole is eccentric with respect to the center of the impeller by approximately half the difference between the second diameter and the first diameter.

5. A fuel pump as claimed in claim 4 wherein the center of the drive shaft substantially coincides with the center of the impeller.

6. A fuel pump as claimed in claim 3 wherein the hole in the impeller is substantially D-shaped, and the drive shaft has a substantially D-shaped transverse cross section.

* * * * *